United States Patent [19]

Alario et al.

[11] Patent Number: 4,515,207

[45] Date of Patent: May 7, 1985

[54] MONOGROOVE HEAT PIPE DESIGN: INSULATED LIQUID CHANNEL WITH BRIDGING WICK

[75] Inventors: Joseph P. Alario, Hauppauge; Richard F. Brown, East Meadow; Robert L. Kosson, Massapequa, all of N.Y.

[73] Assignee: The United States of America as represented by the Administrator of the National Aeronautics and Space Administration, Washington, D.C.

[21] Appl. No.: 615,505

[22] Filed: May 30, 1984

[51] Int. Cl.[3] ..... F28D 15/00

[52] U.S. Cl. ..... 165/1; 122/366; 165/104.26

[58] Field of Search ..... 165/104.26; 122/366

[56] References Cited

U.S. PATENT DOCUMENTS

| | | | |
|---|---|---|---|
| 3,576,210 | 4/1981 | Trent | 165/105 |
| 3,734,173 | 5/1973 | Moritz | 165/104.26 |
| 3,746,081 | 7/1973 | Corman et al. | 165/32 |
| 3,844,342 | 10/1974 | Eninger et al. | 165/104.26 |
| 3,955,619 | 5/1976 | Corman et al. | 165/105 |
| 4,019,571 | 4/1977 | Kosson et al. | 165/105 |
| 4,021,816 | 5/1977 | Peck | 343/840 |

FOREIGN PATENT DOCUMENTS

| | | |
|---|---|---|
| 2430880 | 2/1975 | Fed. Rep. of Germany . |
| 0146989 | 11/1981 | Japan . |
| 0175888 | 10/1982 | Japan . |
| 0853348 | 8/1981 | U.S.S.R. . |

*Primary Examiner*—Albert W. Davis, Jr.

*Attorney, Agent, or Firm*—Russell E. Schlorff; John R. Manning; Marvin F. Matthews

[57] ABSTRACT

A screen mesh artery (50) supported concentrically within the evaporator section (20) of a heat pipe liquid channel (27) retains liquid (41) in the channel (27) and thereby assures continued and uniform liquid feed to the heat pipe evaporation section (20) during periods of excessive heat transfer.

18 Claims, 3 Drawing Figures

FIG. 1
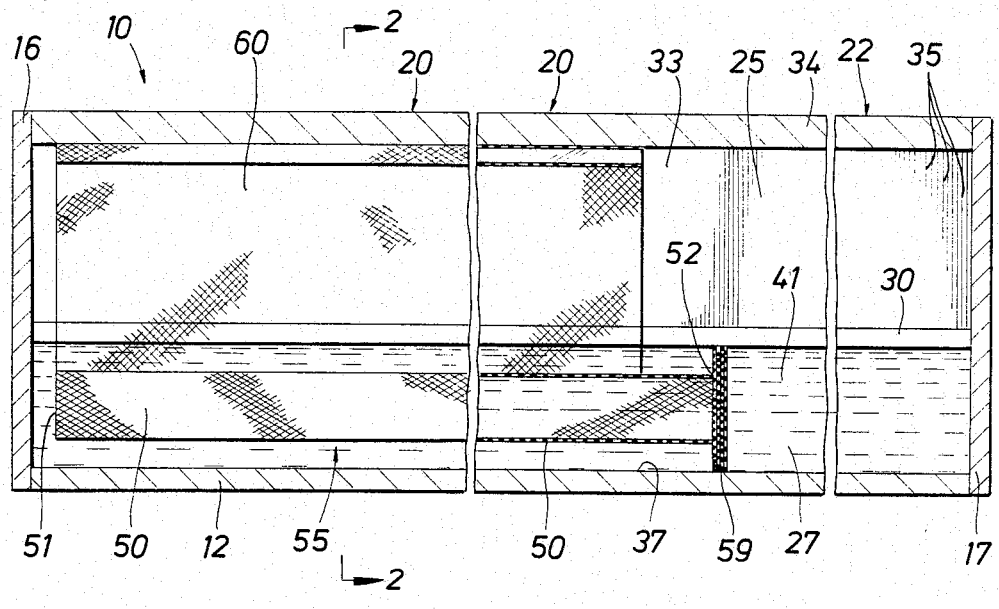
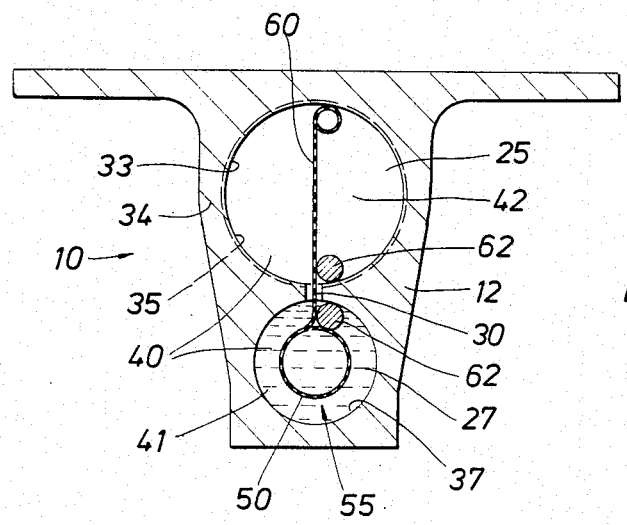
FIG. 2
FIG. 3
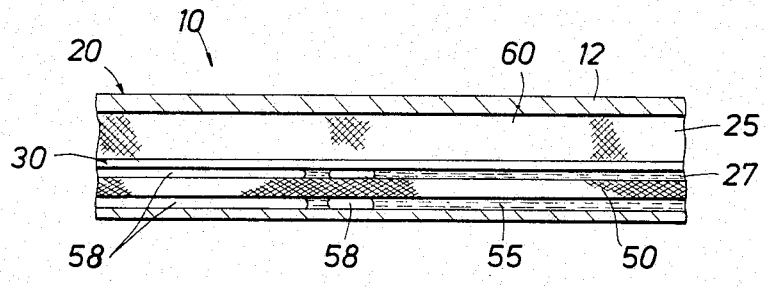

MONOGROOVE HEAT PIPE DESIGN: INSULATED LIQUID CHANNEL WITH BRIDGING WICK

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

CROSS REFERENCE TO RELATED APPLICATION

The present invention is an improvement to the invention disclosed in U.S. patent application Ser. No. 244,290 (Alario, et al., filed Mar. 16, 1981), now U.S. Pat. No. 4,470,451, issued Sept. 11, 1984.

BACKGROUND OF THE INVENTION

1. Field of the Invention

The present invention relates to heat pipes, and more particularly to a monogroove heat pipe having separate channels for the axial transport of the liquid and vapor phases of the working medium, and an artery supported generally concentrically within the evaporation section of the liquid channel for retaining liquid in the channel and assuring liquid feed to the evaporation section during periods of excessive heat transfer thereto.

2. Background of the Invention

Recent monogroove heat pipe developments have produced high performance heat pipes with tested heat transport performances in excess of 14,000 W-m, and theoretical capacities in excess of 25,000 W-m. These improvements represent an increase in heat transport capacity of better than two orders of magnitude over other currently existing heat pipes designed to operate at near ambient temperatures.

The basic monogroove heat pipe design incorporates two relatively large, independent axial channels, a larger one for vapor and a smaller one for liquid. These provide for handling the axial transport of the fluids (liquid and vapor) independently from the radial transfer of the heat, the latter being facilitated by liquid-conducting circumferential wall grooves in the vapor channel. A small capillary slot separates (interconnects) the otherwise independent channels and provides for the passage of fluid therebetween. The small slot sustains a high capillary pressure difference which, coupled with the minimized flow resistance provided by the two separate channels, results in the high axial heat transport capacity of the monogroove heat pipe design. The overall design also provides high evaporation and condensation film coefficients for the working fluid by means of the circumferential grooves in the walls of the vapor channel, while not interfering with the overall heat transport capability of the axial groove.

Such a monogroove heat pipe design has particular utility in zero-g environments, for example, such as for meeting the heat rejection requirements for large space platforms or space stations, and wherein capillary forces alone entirely control the working fluids in the heat pipe operation, no moving parts or auxiliary equipment being required.

As is recognized in this type of design, a continuous liquid flow path between the primary axial channel or groove and the circumferential wall grooves in the evaporation section of the vapor channel must be assured. This continuity must be maintained even with both groove menisci realistically depressed to reflect maximum heat flux conditions. One particular advantage of the monogroove heat pipe design is its inherent resistance to nucleate boiling within the axial liquid flow channel under high loads. In current designs, this is largely a consequence of separating the liquid channel and the heat input zone by locating the heat input zone at the top side of the vapor channel, opposite the liquid channel. Should gas bubbles form or become entrapped within the liquid channel, a particular advantage of the separate liquid and vapor channels is that such gas bubbles can readily be vented into the vapor channel through the common monogroove slot. A disadvantage is that the heat load usually has to be temporarily reduced to reprime the liquid channel.

It is to be expected that, in typical applications, periods of excessive heat transfer to the heat pipe will occur from time to time. Even without excessive heat transfer, it has been observed that loss of subcooling in the liquid channel in the evaporation section (caused, for example, by heat conducted to the liquid channel through the heat pipe walls) will limit heat transport capacity and cause high temperature gradients in the channel, largely due to vapor formation in the liquid channel. This results, in fact, in a substantial degradation of performance. It can be controlled to some extent by contouring the heat pipe walls to minimize such heat conduction, but such measures are limited where high-pressure fluids, such as ammonia, are used, since it can result in an unacceptably weak section subject to severe distortion under load.

A need therefore remains for a monogroove heat pipe which is resistant to superheating of the liquid channel in the evaporation section, and which will maintain and preserve the continuity of the fluid flow within the liquid channel to the evaporation section even during periods of excessive heat transfer thereto.

SUMMARY OF THE INVENTION

Briefly, the present invention meets the above needs with a monogroove heat pipe, of the above overall design, which is also provided with an insulated liquid chanel. More particularly, a screen mesh artery is supported concentrically within the evaporator portion of the heat pipe liquid channel. During normal operation, the entire channel is filled with liquid. However, during periods wherein subcooling is lost, for example during periods of excessive heat transfer to the evaporation section of the heat pipe, the concentric screen mesh artery acts in cooperation with the liquid channel to isolate the liquid column from the evaporator wall. More particularly, during excessive heat transfer the liquid will boil in the annulus surrounding the screen mesh artery, causing a loss of liquid from the annulus. The annulus then contains slightly superheated vapor which serves to insulate the central screen artery from further liquid loss. In the preferred embodiment the screen artery is sized so that the pipe retains at least 90% of its original theoretical transport capacity.

The preferred embodiment also includes a bridging wick which provides an alternate feed path between the liquid channel and the circumferential grooves in the walls of the vapor channel. The bridging wick extends from the screen mesh artery, through the capillary slot, into and across the vapor channel, and into contact with the inside surface of the vapor channel substantially opposite the capillary slot. The bridging wick thus provides a parallel or auxiliary liquid flow or feed path between the screen mesh artery in the liquid channel and the capillary slot which joins the liquid and vapor channels (the capillary slot being the primary feed for liquid to the circumferential grooves in the vapor channel). The bridging wick also provides a parallel liquid feed path between the screen mesh artery and the ends of the vapor channel wall grooves farthest from the capillary slot. This improves the overall heat transfer coefficient by eliminating local dryout (hot spots) at the primary heat input zone.

It is therefore an object of the present invention to provide an improved monogroove heat pipe; a monogroove heat pipe resistant to superheating of the liquid in the liquid channel; in which the liquid channel is insulated, as needed, in the evaporation section of the heat pipe; in which an artery is located within at least the evaporation section of the liquid channel, spaced from and substantially free of thermal contact with the inside surface of the liquid channel, to define an annulus surrounding the artery between the artery and the inside surface of the liquid channel; in which the artery retains a continuous liquid column therein, and hence in the core of the liquid channel, in the event that a period of excessive heat transfer to the evaporation section of the heat pipe causes boiling and loss of liquid from the surrounding annulus; in which the resultant vapor in the annulus then serves to insulate and thermally isolate the artery from further liquid loss through vaporization therewithin, and to preserve the continuity of the fluid flow within the liquid channel to the evaporation section; in which an auxiliary liquid flow path is provided from the artery to the capillary slot in the evaporation section of the envelope for assuring liquid feed to the wall capillary on the inside surface of the vapor channel in the evaporation section during such an excessive heat transfer period; and to accomplish the above objects and purposes in an effective, highly efficient, reliable, durable, and economical configuration readily applicable to virtually any monogroove heat pipe design.

Other objects and advantages of the invention will be apparent from the following description, the accompanying drawings and the appended claims.

BRIEF DESCRIPTION OF THE DRAWINGS

FIG. 1 is a longitudinal cross-sectional view of a preferred embodiment of the screen mesh artery incorporated into a monogroove heat pipe according to the present invention;

FIG. 2 is a cross-sectional view of the embodiment shown in FIG. 1, taken on line 2—2 thereof; and FIG. 3 is a fragmentary cross-sectional view, similar to FIG. 1 but on a smaller scale, illustrating retention of liquid within the screen mesh artery during formation of vapor in the annulus due to excessive heat transfer to the liquid channel.

DESCRIPTION OF THE PREFERRED EMBODIMENT

With reference to the drawings, the improved monogroove heat pipe having an insulated liquid channel, and the method for retaining a continuous liquid column of working fluid within the liquid channel, according to the present invention, will now be described. FIGS. 1 and 2 show a preferred embodiment of the heat pipe 10 of the invention.

Heat pipe 10 includes an elongated, hermetically sealed envelope 12 having end walls 16 and 17 respectively on the ends of the evaporation section 20 and condensing section 22 of the heat pipe. The envelope and end walls, in the preferred embodiment, are fabricated of aluminum, but any other suitable material, metallic or non-metallic as appropriate, having the required thermal conductivity and resistance to corrosion in the environment of use, can be employed.

Heat pipe 10 has a tubular longitudinal vapor channel 25 and a tubular longitudinal liquid channel 27 extending the length thereof in a side-by-side relationship, with the axes of the channels parallel to one another. As is usual, the condensing section 22 operates at a slightly lower temperature than the evaporation section 20.

Joining the channels 25 and 27, such that they are in fluid communication at least in the condensing and evaporation sections 22 and 20 thereof, is a capillary slot 30 extending longitudinally within the envelope 12. Slot 30, which is as narrow as possible to maximize the capillary pressure differential, may be provided along the entire heat pipe length, as illustrated in the drawing figures. However, slot 30 is actually essential only in the evaporation and condensing sections of the heat pipe. Therefore, in applications in which the evaporation and condensing sections 20 and 22 are located remotely from one another, the intermediate transport sections of the vapor and liquid channels may each be fabricated, for example, of plain-wall tubing, without capillary slot 30.

The interior or inside surface 33 of the peripheral wall 34 of the vapor channel 25 is provided with closely spaced, generally circumferentially extending wall capillary grooves 35 in at least the condensing and evaporation sections thereof. The grooves 35 may be incised as a continuous helical groove to faclitate manufacture, or a series of separate annular grooves can be provided. Of course, no such grooves are needed on the inside wall surface 37 of the liquid channel 27.

During manufacture, envelope 12 is first evacuated, and then a suitable quantity of a vaporizable working fluid 40 is introduced and sealed therein. The fluid has a liquid phase 41 and a vapor phase 42 at the operating temperature and pressure of the heat pipe, for evaporating in the high-temperature evaporation section 20 and condensing in the low-temperature condensing section 22, to transfer heat from the evaporation section to the condensing section by phase change of the fluid. More particularly, the circumferential wall grooves 35 in the evaporation section 20 of the heat pipe 10 are filled with liquid pumped there from the liquid channel 27 by capillary action. When exposed to a relatively high temperature, evaporation then occurs at the meniscus contact line of the grooves. The vapor phase then flows along the vapor channel 25 from the evaporation section 20 to the condensing section 22, substantially independently of the liquid phase in channel 27. In the condensing section 22, which is at a relatively lower temperature, the vapor phase working fluid 42 is condensed and the resultant liquid phase 41, which substantially fills the liquid channel at the normal operating temperature, flows along the liquid channel 27 and is returned from the condensing section 22 to the evaporation section 20. The liquid fluid then again flows into the wall grooves 35 by capillary action, such that evaporation again occurs, and the cycle thus repeats.

From time to time the heat pipe may be subjected to a period of excessive heat transfer to the evaporation section 20 of the heat pipe. To preserve subcooling in the liquid channel 27 and thus protect the continuity of the liquid feed therein, the heat pipe of the present invention has an artery 50 for the liquid phase working fluid 41. Artery 50, having ends 51 and 52, is located in at least the evaporation section of the liquid channel. The end 51 of artery 50 is adjacent and offset from the end wall 20 (FIG. 1); artery end 52 is closer to the condensing section 20, preferably extending in that direction beyond the end of evaporation section 20. In the preferred embodiment, artery 50 is a 180 mesh stainless steel screen artery which is supported concentrically within channel 27, spaced from and free of thermal contact with the inside surface 37 of the liquid channel 27. Artery 50 thus cooperates with channel 27 to define an annulus 55 surrounding the artery between the artery 50 and the liquid channel inside surface 37. In the event that excessive heat transfer then causes boiling and loss of liquid from the surrounding annulus 55, the annulus will contain slightly superheated vapor 58 (see FIG. 3). Such vapor then serves to insulate the central screen artery 50 from further heat input, and thus from further liquid loss through vaporization therewithin. In other words, the screen artery 50 functions at such times, in cooperation with the annulus 55 which it defines, to provide an isolated, insulated liquid feed channel for the evaporation section 20 of the heat pipe 10, thereby retaining a continuous liquid column in the artery 50, and hence in the core of the liquid channel 27. This preserves the continuity of the fluid within the liquid channel 27 to the evaporation section 20 of the heat pipe 10.

In the preferred embodiment, liquid channel 27 and end 52 of artery 50 are closed by a porous plug 59 (FIG. 1) extending entirely thereacross. Plug 59 is preferably made of four layers of the same 180 mesh stainless steel screen as is used for artery 50, and easily conducts liquid flowing therethrough toward evaporation section 20. However, in the event that vapor forms in annulus 55 (FIG. 3), plug 59 prevents the vapor from flowing beyond the end 52 of artery 50. Otherwise the vapor might start forcing liquid from the liquid channel into the vapor channel (in the condensing section). Also, as the vapor forms in annulus 55, it can cause pressure fluctuations which can lead to flow instabilities. Plug 59 effectively counteracts and controls such pressure fluctuations.

A stainless steel mesh screen bridging wick 60, connected to artery 50, extends from artery 50 through the capillary slot 30, into and across the vapor channel 25, and into contact with the inside surface 33 of the vapor channel 25 substantially opposite the capillary slot 30. Wick 60 is held in position, and supports artery 50 in its proper position, by longitudinal rods 62 engaged on either side of slot 30 (see FIG. 2). The wick then provides an auxiliary or parallel liquid flow or feed path from artery 50 to the capillary slot 30 in the evaporation section 20 of the heat pipe envelope 12. It further provides such a liquid feed path directly to the vapor channel wall capillary grooves 35 farthest from the slot 30. A relatively uniform liquid feed to the wall capillary grooves 35 throughout the inside surface 33 of the vapor channel 25 in the evaporation section 20 is thus assured during such an excessive heat transfer period. This significantly improves the overall heat transfer coefficient of the heat pipe 10 by eliminating local dryout (hot spots) at the primary heat input zone.

As may be seen, therefore, the present invention provides numerous advantages. In particular, it provides a substantially improved monogroove heat pipe and method which are resistant to superheating of the liquid channel in the evaporation section, and which maintain and preserve the continuity of the fluid flow within the liquid channel to the evaporation section even during periods of excessive heat transfer thereto. The invention thus provides for sustained and sustainable operation much closer to the normal theoretical design capacity of such monogroove heat pipes, as well as for maintaining continued heat pipe function even during periods of such overload. The invention thus provides an effective, highly efficent, reliable, durable, and economical configuration readily applicable to virtually any monogroove heat pipe design.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. In a heat pipe having an elongated, sealed envelope, the envelope having a condensing section for operation at a relatively low temperature, an evaporation section for operation at a relatively high temperature, separate vapor and liquid channels extending between the condensing and evaporation sections, the vapor and liquid channels being in a substantially longitudinally parallel side-by-side relationship at least in the evaporation and condensing sections, wall capillary means on the inside surface of the vapor channel in at least the condensing and evaporation sections, slot capillary means extending longitudinally within the envelope at least in the evaporation and condensing sections thereof for providing fluid communication between the vapor and liquid channel, a vaporizable working fluid in the envelope, the fluid having a liquid phase and a vapor phase at the operating temperature of the heat pipe for evaporating in the high-temperature evaporation section and condensing in the low-temperature condensing section to transfer heat from the evaporation to the condensing section by phase change of the fluid, the liquid phase substantially filling the liquid channel at the operating temperature and flowing from the condensing section to the evaporation section, and the vapor phase flowing substantially independently along the vapor channel from the evaporation section to the condensing section, the improvement comprising:

(a) artery means within at least the evaporation section of the liquid channel for defining an artery therein for the working fluid, said artery being spaced from and substantially free of thermal contact with the inside surface of the liquid channel to define an annulus surrounding said artery between said artery and the inside surface of the liquid channel, for retaining a continuous liquid column in said artery, and hence in the core of the liquid channel, in the event that a period of excessive heat transfer to the evaporation section of the heat pipe causes boiling and loss of liquid from said surrounding annulus, the resultant vapor in said annulus then serving to insulate and thermally isolate said artery from further liquid loss through vaporization therewithin, and to preserve the continuity of the fluid flow within the liquid channel to the evaporation section, and (b) means for providing an auxiliary liquid flow path from said artery to the slot capillary means in the evaporation section of the envelope for assuring liquid feed to the wall capillary means on the inside surface of the vapor channel in the evaporation section during such an excessive heat transfer period.

2. The improvement of claim 1 further comprising means for supporting said artery means substantially concentrically within the liquid channel.

3. The improvement of claim 1 wherein said artery means is substantially a metallic screen cylinder.

4. The improvement of claim 1 wherein said means for providing an auxiliary liquid flow path further comprises a bridging wick extending from said artery at least to the slot capillary means.

5. The improvement of claim 4 wherein said bridging wick extends through the slot capillary means, into and across the vapor channel, and into contact with the inside surface of the vapor channel substantially opposite the slot capillary means to feed liquid to the vapor channel wall capillary means farthest from the slot capillary means.

6. The improvement of claim 4 wherein said bridging wick is formed of metallic screen.

7. The improvement of claim 1 wherein said artery is sized relative to the liquid channel to preserve at least half of the original transport capacity of the heat pipe.

8. The improvement of claim 1 wherein the end of said artery closer to the condensing section extends in that direction beyond the end of the evaporation section, and further comprising plug means defining a porous plug extending across the liquid channel at said artery end for conducting liquid therethrough while preventing vapor from flowing therepast.

9. In a heat pipe having a hermetically sealed, elongated, thermally conductive envelope, the envelope having a condensing section for operation at a relatively low temperature, an evaporation section for operation at a relatively high temperature, separate longitudinal vapor and liquid channels extending the length of the envelope in a substantially parallel side-by-side relationship, wall capillary means on the inside surface of the vapor channel in at least the condensing and evaporation sections thereof, slot capillary means extending longitudinally within the envelope at least in the evaporation and condensing sections thereof for providing fluid communication between the vapor and liquid channels, a vaporizable working fluid in the envelope, the fluid having a liquid phase and a vapor phase at the operating temperature of the heat pipe for evaporating in the high-temperature evaporation section and condensing in the low-temperature condensing section to transfer heat from the evaporation to the condensing section by phase change of the fluid, the liquid phase substantially filling the liquid channel at the operating temperature and flowing from the condensing section to the evaporation section, and the vapor phase flowing substantially independently along the vapor channel from the evaporation section to the condensing section, the improvement comprising:

(a) cylindrical stainless steel mesh screen artery insert means supported substantially concentrically within the liquid channel within at least the evaporation section of the liquid channel for defining an artery therein for the working fluid, the end of said artery closer to the condensing section extending in that direction beyond the end of the evaporation section, said artery being sized relative to the liquid channel to preserve at least 90% of the original transport capacity of the heat pipe itself, and being spaced from and substantially free of thermal contact with the inside surface of the liquid channel to define an annulus surrounding said artery between said artery and the inside surface of the liquid channel, for retaining a continuous liquid column in said artery, and hence in the core of the liquid channel, in the event that a period of excessive heat transfer to the evaporation section of the heat pipe causes boiling and loss of liquid from said surrounding annulus, the resultant vapor in said annulus then serving to insulate and thermally isolate said artery from further liquid loss through vaporization therewithin, and to preserve the continuity of the fluid flow within the liquid channel to the evaporation section, (b) stainless steel mesh screen plug means defining a porous plug extending across the liquid channel at the end of said artery closer to the condensing section for conducting liquid therethrough while preventing vapor from flowing therepast, and (c) a stainless steel mesh screen bridging wick extending from said artery through the slot capillary means, into and across the vapor channel, and into contact with the inside surface of the vapor channel substantially opposite the slot capillary means, to provide an auxiliary liquid flow path from said artery to the slot capillary means in the evaporation section of the envelope and also to feed liquid directly to the vapor channel wall capillary means farthest from the slot capillary means, thereby assuring a relatively uniform liquid feed to the wall capillary means throughout the inside surface of the vapor channel in the evaporation section during such an excessive heat transfer period.

10. In a method for preserving the continuity of the fluid flow within the liquid channel to the evaporation section of a heat pipe, the heat pipe having an elongated, sealed envelope, the envelope having a condensing section for operation at a relatively low temperature, an evaporation section for operation at a relatively high temperature, separate vapor and liquid channels extending between the condensing and evaporation sections, the vapor and liquid channels being in a substantially longitudinally parallel side-by-side relationship at least in the evaporation and condensing sections, wall capillary means on the inside surface of the vapor channel in at least the condensing and evaporation sections, slot capillary means extending longitudinally within the envelope at least in the evaporation and condensing sections thereof for providing fluid communication between the vapor and liquid channels, a vaporizable working fluid in the envelope, the fluid having a liquid phase and a vapor phase at the operating temperature of the heat pipe for evaporating in the high-temperature evaporation section and condensing in the low-temperature condensing section to transfer heat from the evaporation to the condensing section by phase change of the fluid, the liquid phase substantially filling the liquid channel at the operating temperature and flowing from the condensing section to the evaporation section, and the vapor phase flowing substantially independently along the vapor channel from the evaporation section to the condensing section, the improvement comprising:

(a) retaining a continuous liquid column of the working fluid within an artery located within at least the evaporation section of the liquid channel, (b) supporting the artery spaced from and substantially free of thermal contact with the inside surface of the liquid channel to define an annulus surrounding the artery between the artery and the inside surface of the liquid channel, such that during a period in which excessive heat transfer to the evaporation section of the heat pipe causes boiling and loss of liquid from the surrounding annulus, the resultant vapor in the annulus then serves to insulate and thermally isolate the artery from further liquid loss through vaporization therewithin, thereby retaining the continuous liquid column in the artery, and hence in the core of the liquid channel, and preserving the continuity of the fluid flow within the liquid channel to the evaporation section, and (c) feeding liquid from the artery to the wall capillary means on the inside surface of the vapor channel in the evaporation section, during such an excessive heat transfer period, through an auxiliary liquid flow path from the artery to the slot capillary means in the evaporation section of the envelope.

11. The method of claim 10 further comprising supporting the artery substantially concentrically within the liquid channel.

12. The method of claim 10 wherein the artery is substantially a metallic screen cylinder.

13. The method of claim 10 wherein said step of feeding liquid to the wall capillary means further comprises feeding the liquid by means of a bridging wick extending from the artery at least to the slot capillary means.

14. The method of claim 13 further comprising feeding liquid from the artery to the vapor channel wall capillary means farthest from the slot capillary means through a bridging wick which extends through the slot capillary means, into and across the vapor channel, and into contact with the inside surface of the vapor channel substantially opposite the slot capillary means.

15. The method of claim 13 wherein the bridging wick is formed of metallic screen.

16. The method of claim 10 wherein the artery is sized relative to the liquid channel to perserve at least half of the original transport capacity of the heat pipe.

17. The method of claim 10 wherein the end of the artery closer to the condensing section extends in that direction beyond the end of the evaporation section, and further comprising preventing vapor from flowing therepast using a porous plug extending across the liquid channel at the artery end, while conducting liquid therethrough.

18. In a method for preserving the continuity of the fluid flow within the liquid channel to the evaporation section of a heat pipe, the heat pipe having a hermetically sealed, elongated, thermally conductive envelope, the envelope having a condensing section for operation at a relatively low temperature, an evaporation section for operation at a relatively high temperature, separate longitudinal vapor and liquid channels extending the length of the envelope in a substantially parallel side-by-side relationship, wall capillary means on the inside surface of the vapor channel in at least the condensing and evaporation sections thereof, slot capillary means extending longitudinally within the envelope at least in the evaporation and condensing sections thereof for providing fluid communication between the vapor and liquid channels, a vaporizable working fluid in the envelope, the fluid having a liquid phase and a vapor phase at the operating temperature of the heat pipe for evaporating in the high-temperature evaporation section and condensing in the low-temperature condensing section to transfer heat from the evaporation to the condensing section by phase change of the fluid, the liquid phase substantially filling the liquid channel at the operating temperature and flowing from the condensing section to the evaporation section, and the vapor phase flowing substantially independently along the vapor channel from the evaporation section to the condensing section, the improvement comprising:

(a) retaining a continuous liquid column of the working fluid within a cylindrical stainless steel mesh screen artery insert located within at least the evaporation section of the liquid channel, the end of the artery closer to the condensing section extending in that direction beyond the end of the evaporation section, and the artery being sized relative to the liquid channel to preserve at least 90% of the original transport capacity of the heat pipe itself, (b) supporting the artery substantially concentrically within the liquid channel and spaced from and substantially free of thermal contact with the inside surface of the liquid channel to define an annulus surrounding the artery between the artery and the inside surface of the liquid channel, such that during a period in which excessive heat transfer to the evaporation section of the heat pipe causes boiling and loss of liquid from the surrounding annulus, the resultant vapor in the annulus then serves to insulate and thermally isolate the artery from further liquid loss through vaporization therewithin, thereby retaining a continuous liquid column in the artery, and hence in the core of the liquid channel, and preserving the continuity of the fluid flow within the liquid channel to the evaporation section, (c) preventing vapor from flowing past the end of the artery closer to the condensing section using a stainless steel mesh screen porous plug extending across the liquid channel at the artery end, while conducting liquid therethrough, and (d) feeding liquid from the artery relatively uniformly to the wall capillary means on the inside surface of the vapor channel in the evaporation section, during such an excessive heat transfer period, through a stainless steel mesh screen bridging wick extending from the artery through the slot capillary means, into and across the vapor channel, and into contact with the inside surface of the vapor channel substantially opposite the slot capillary means, the wick providing an auxiliary liquid flow path from the artery to the slot capillary means and to the vapor channel wall capillary means farthest from the slot capillary means.

* * * * *